US008506265B2

(12) United States Patent
Lee

(10) Patent No.: US 8,506,265 B2
(45) Date of Patent: Aug. 13, 2013

(54) ELECTRIC FAN WITH MULTIPLE SELECTION OF OSCILLATING ANGLES

(76) Inventor: Wen Ching Lee, Taichung (TW)

( * ) Notice: Subject to any disclaimer, the term of this patent is extended or adjusted under 35 U.S.C. 154(b) by 577 days.

(21) Appl. No.: 12/784,493

(22) Filed: May 20, 2010

(65) Prior Publication Data

US 2011/0008190 A1 Jan. 13, 2011

(30) Foreign Application Priority Data

Jul. 8, 2009 (CN) ..... 2009 2 0163697 U

(51) Int. Cl.
*B64C 11/06* (2006.01)
*B64C 11/30* (2006.01)

(52) U.S. Cl.
USPC ..... 417/423.1; 417/423.6; 417/423.15; 417/424.1; 417/424.2; 415/118; 416/100; 416/61

(58) Field of Classification Search
USPC ..... 416/100, 61; 415/118; 417/423.1, 417/423.6, 423.15, 481, 424.1, 424.2
See application file for complete search history.

(56) References Cited

U.S. PATENT DOCUMENTS 722,208 A * 3/1903 Chandler ..... 74/421 R
4,361,787 A * 11/1982 Negishi et al. ..... 318/6
4,703,152 A * 10/1987 Shih-Chin ..... 392/366
5,256,039 A * 10/1993 Crawford ..... 417/234
5,720,594 A * 2/1998 Snow ..... 416/100
5,816,079 A * 10/1998 Wang ..... 66/218
6,299,600 B1 * 10/2001 Masaoka et al. ..... 604/118
6,759,648 B2 * 7/2004 Baxter et al. ..... 250/231.13
7,052,239 B1 * 5/2006 Riske ..... 416/100
7,811,059 B2 * 10/2010 Sagucio ..... 416/100
2002/0182075 A1 * 12/2002 Pan et al. ..... 416/100
2005/0223832 A1 * 10/2005 Li et al. ..... 74/425

FOREIGN PATENT DOCUMENTS

JP 61129498 A * 6/1986

OTHER PUBLICATIONS

Translation of JP 61-129498.*

* cited by examiner

*Primary Examiner* — Charles Freay
*Assistant Examiner* — Christopher Bobish

(57) ABSTRACT

An electric fan includes a fan shaft driven by a fan motor supported by a motor support. An oscillating device includes a rotational shaft connected to the motor support for driving the motor support to oscillate. A transmission gear has an axle connected to the rotational shaft and a gear wheel mounted around the axle and driven by a synchronous motor. An oscillating angle limiting switch detects a rotational angle of the rotational shaft and the gear wheel and sends a signal indicative of the rotational angle. A circuit board has a processor coupled to the oscillating angle limiting switch and receives the signal. A comparing program compares the rotational angle indicated by the signal with a selected one of a plurality of preset rotational angles. The synchronous motor is driven when the rotational angle indicated by the signal is equal to the selected preset rotational angle.

5 Claims, 6 Drawing Sheets

ELECTRIC FAN WITH MULTIPLE SELECTION OF OSCILLATING ANGLES

BACKGROUND OF THE INVENTION

The present invention relates to an electric fan and, more particularly, to an electric fan allowing selection of oscillating angles and including an oscillating angle limitation switch to limit an oscillating angle of the electric fan.

Electric fans generally include a fan driven by a motor to provide air currents for cooling purposes. Although air conditioners are widely used, electric fans are still an option in view of costs and energy conservation in many families, offices, public areas, and industries requiring dissipation of heat.

Currently available electric fans include a power on/off switch and a plurality of speed buttons to allow selection of the speed of the motors of the electric fans for adjusting the wind output. Some of the electric fans include a rotary mechanism to allow rotation of a seat of the motor such that the fan can oscillate in an angle relative to a base of the electric fan, providing wind output in a wider range. However, the oscillating angle of the fan can not be adjusted. Namely, the fan can only oscillate in a preset angle of the electric fan, leading to limitation to the wind output.

Thus, a need exists for an electric fan allowing selection of oscillating angles.

BRIEF SUMMARY OF THE INVENTION

The present invention solves this need and other problems in the field of adjustable oscillating angles of electric fans by providing, in a preferred form, an electric fan including a fan body having a plurality of vanes connected to a fan shaft. A fan motor includes a transmission shaft and a fixing portion. The transmission shaft is connected to the fan shaft for driving the fan shaft and the vanes to rotate. A motor support is connected to the fixing portion of the fan motor. An oscillating device is mounted in a housing and includes a rotational shaft having an end connected to the motor support for driving the motor support to oscillate. The oscillating device further includes a transmission gear having an axle connected to the rotational shaft and a gear wheel mounted around the axle. The oscillating device further includes a synchronous motor having an output gear meshed with the gear wheel. The oscillating device further includes an oscillating angle limiting switch detecting a rotational angle of the rotational shaft and the gear wheel and sending a signal indicative of the rotational angle of the rotational shaft and the gear wheel. The oscillating device further includes a circuit board having a processor coupled to the oscillating angle limiting switch and receiving the signal. The circuit board is loaded with data of a plurality of preset rotational angles. A comparing program is written into the circuit board and compares the rotational angle indicated by the signal with a selected one of the plurality of preset rotational angles. A driving program is written into the circuit board and drives the synchronous motor when the rotational angle indicated by the signal is equal to the selected one of the plurality of preset rotational angles.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
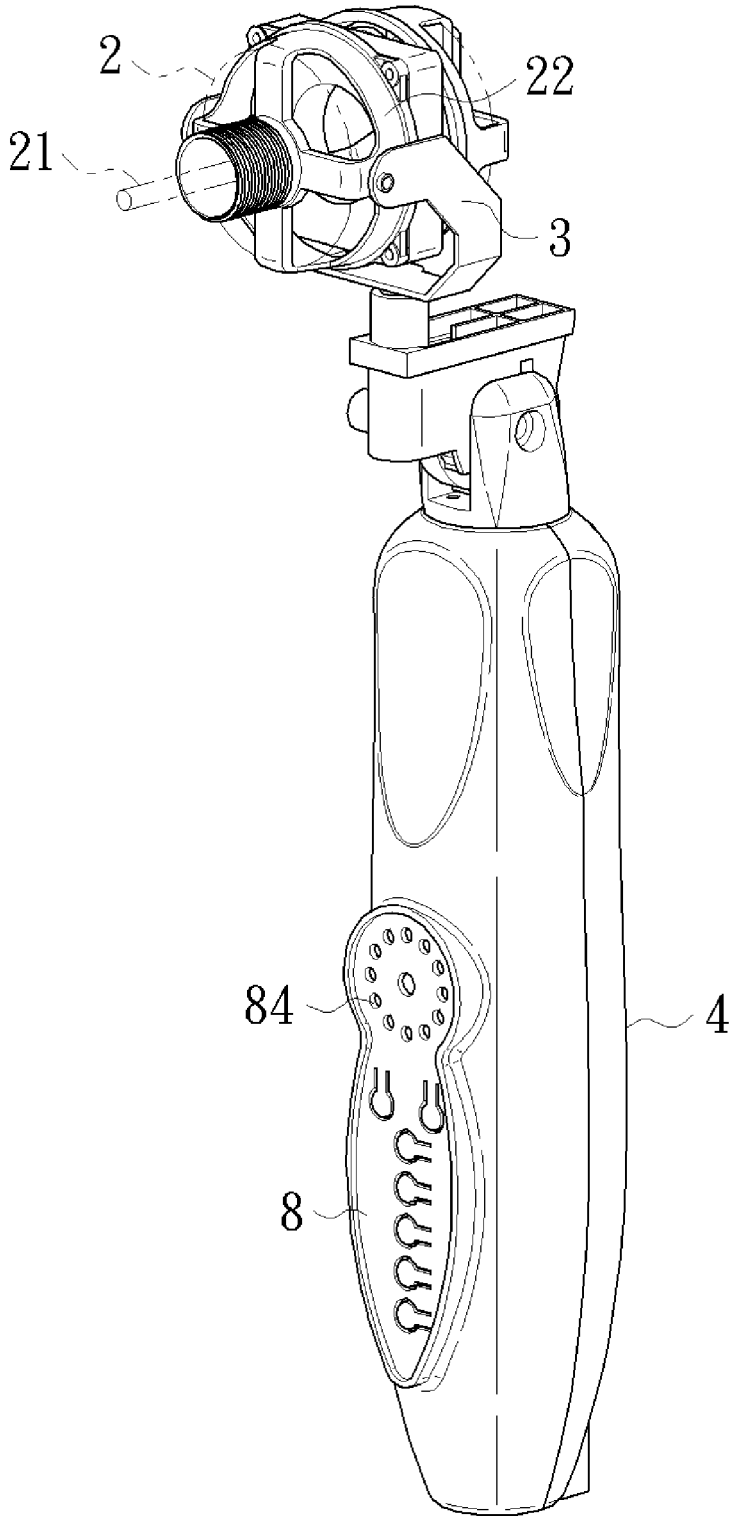
FIG. 1 shows a partial, perspective view of an electric fan according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

An electric fan according to the preferred teachings of the present invention is shown in the drawings and generally includes a fan body 1 having a plurality of vanes 10 connected to a fan shaft 11. A fan motor 2 includes a transmission shaft 21 connected to the fan shaft 11 for driving the fan shaft 11 and the vanes 10 to rotate. The fan motor 2 further includes a fixing portion 22. A motor support 3 is connected to the fixing portion 22 of the fan motor 2.

An oscillating device 5 is mounted in a housing 4 and includes a rotational shaft 52 having an end connected to the motor support 3 for driving the motor support 3 to oscillate. The oscillating device 5 further includes a transmission gear 53 having an axle 531 and a gear wheel 533 mounted around the axle 531. The axle 531 is connected to the rotational shaft 52. A grating 532 is mounted to the transmission gear 53 and located on top of and coaxial to the gear wheel 533, effectively using the space in the housing 4. The grating 532 includes a plurality of annularly spaced protrusions 532A with a groove 532B formed between two adjacent protrusions 532A. A synchronous motor 54 is mounted in the housing 4 and includes an output shaft with an output gear 541 meshed with the gear wheel 533.

The oscillating device 5 further includes an oscillating angle limiting switch capable of detecting a rotational angle of the rotational shaft 52/gear wheel 533. The oscillating angle limiting switch can be of any desired form, such as a microswitch or tact switch. In the preferred form shown, the oscillating angle limiting switch is a photo sensor 55 fixed in the housing 4 and detects the actual number of protrusions 532A or grooves 532B passing therethrough during rotation of the grating 532. The photo sensor 55 is substantially slanted U-shaped and has an opening 551 through which the protrusions 532A/grooves 532B pass, effectively using the space in the housing 4. The photo sensor 55 converts data of an actual number 561 of protrusions 532A or grooves 532B passing through the photo sensor 55 into a signal.

A circuit board 56 is mounted in the housing 4 and includes a processor 560 coupled to the photo sensor 55 to receive the signal indicative of the data of the actual number 561 of protrusions 532A or grooves 532B passing through the photo sensor 55. The circuit board 56 is loaded with data of a plurality of preset numbers 562 of protrusions 532A or grooves 532B passing through the photo sensor 55 corresponding to a plurality of differing preset oscillating angles. Furthermore, a comparing program 563 is written into the circuit board 56 and compares the data of actual number 561 with a selected one of the preset numbers 562. A driving program 54 is written into the circuit board 56 for driving the synchronous motor 54 to rotate in a reverse direction after comparison of the data of actual number 561 with the selected preset number 562.

In practice, 360° is divided by the number of protrusions 532A or grooves 532B of the grating 532 such that the rotational angle of the transmission gear 53 (also the rotational angle of the motor 2, the motor support 3, the transmission shaft 21, and the fixing portion 22) can be detected by counting the actual number of protrusions 532A or grooves 532B. The signals indicative of the actual number of protrusions 532A or grooves 532B passing through the photo sensor 55 are continuously sent to the circuit board 56. When the actual number of protrusions 532A or grooves 532B passing through the photo sensor 55 is equal to the selected preset number 562, the synchronous motor 54 rotates in a reverse direction to drive the fan motor 2 in the reverse direction. Thus, the oscillating angle of fan body 1 can be selected by selecting the preset numbers 562 respectively indicative of a plurality of different oscillating angles of the fan body 1. In examples shown in FIGS. 5A-5D, the rotational shaft 52 and the motor support 3 can respectively oscillate in 90°, 180°, 270°, and 360°, depending on selection of the preset numbers 562. However, the fan body 1 can oscillate in a range of 0-360° according to needs.

The oscillating angle limit switch can also include a timing program to restrain the rotational angle of the synchronous motor 54 by controlling the time. As an example, when the rotational angle of the synchronous motor 54 is selected as 30°, based on the timing program written into the circuit board 56, a signal is sent to drive the synchronous motor 54 to rotate in a direction for 3 seconds (equal to the travel of 15°), and another signal is sent to drive the synchronous motor 54 to rotate in a reverse direction for 6 seconds (equal to the travel of 30°). Driving of the synchronous motor 54 with a different rotational angle corresponding to a different preset number 562 can be achieved through control of the rotating time of the synchronous motor 54 in a similar way.

Figure 3:
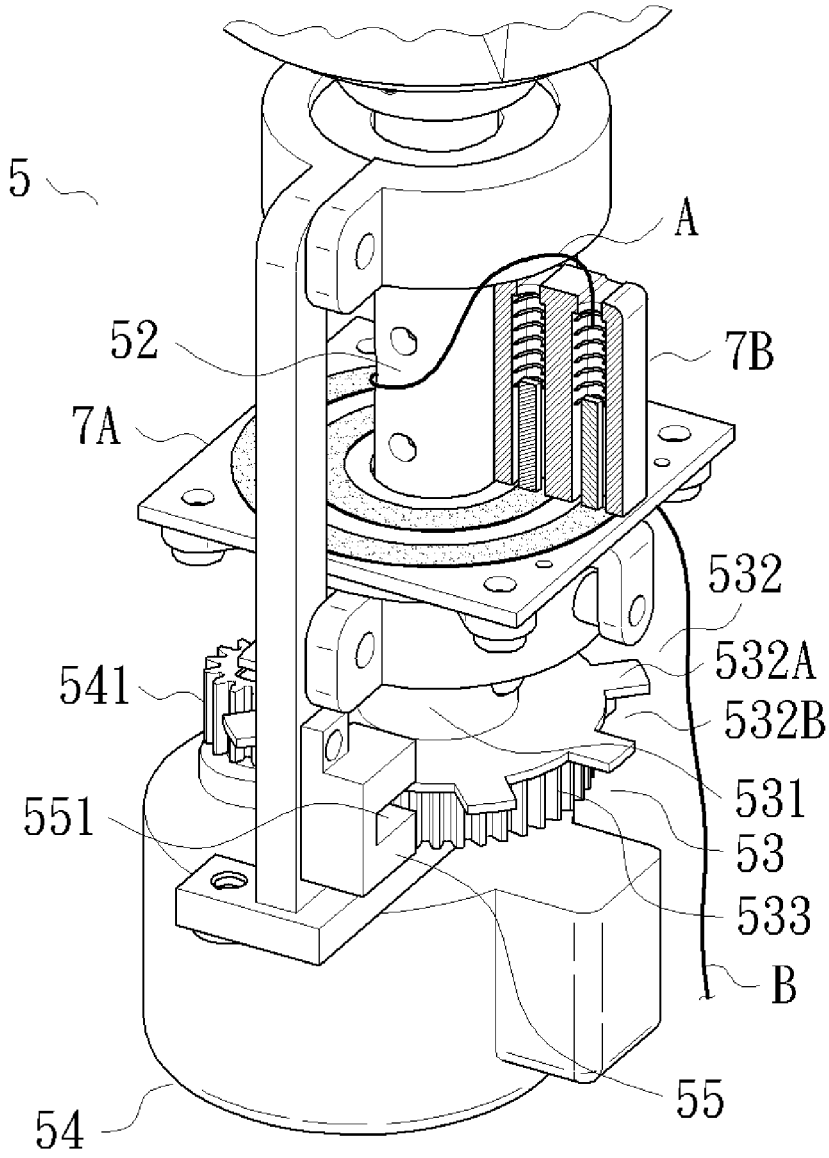
FIG. 3 shows a partial, perspective view of the electric fan of FIG. 1 with portions broken away.
Figure 4:
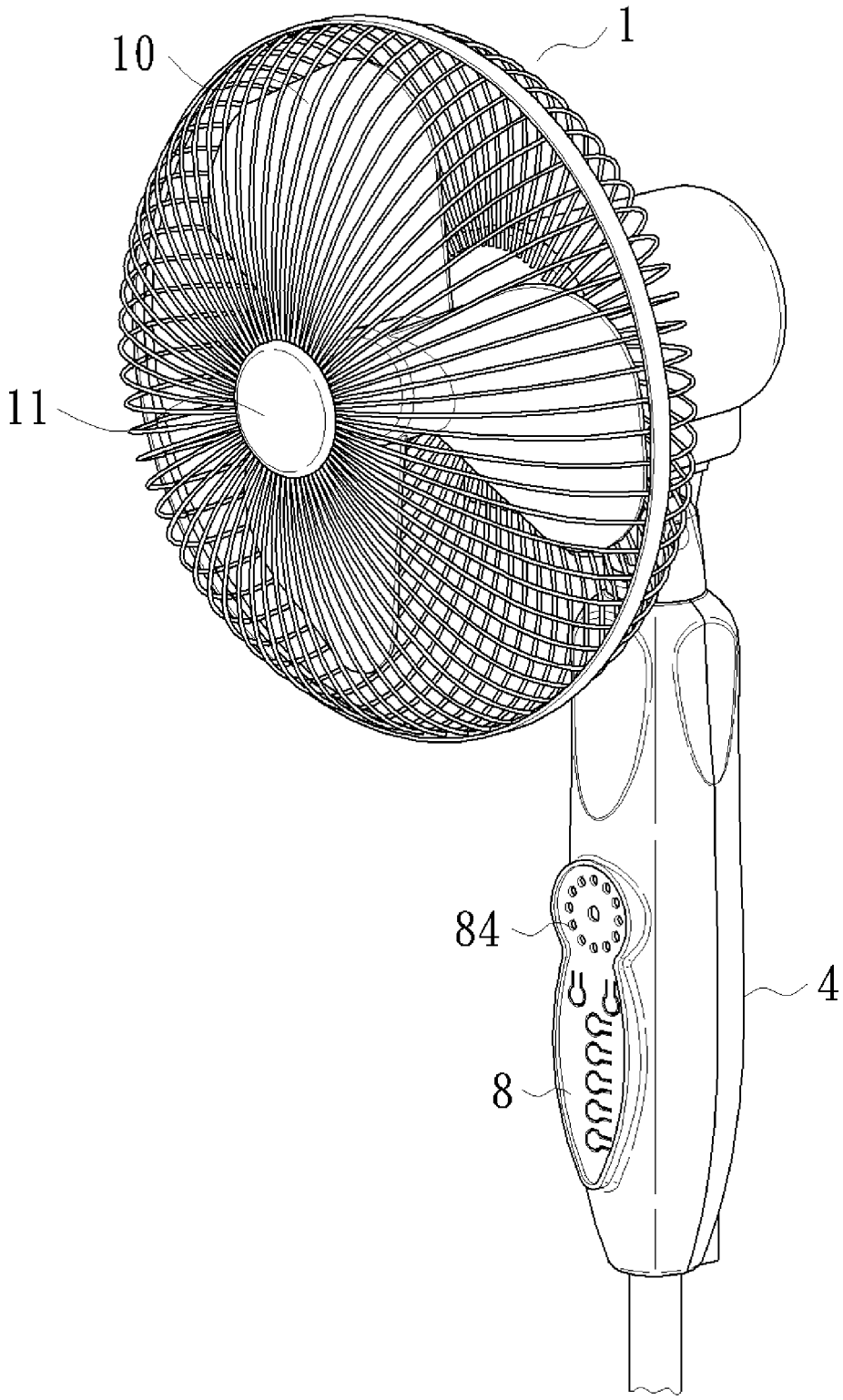
FIG. 4 shows a partial, perspective view of the electric fan according to the preferred teachings of the present invention.
Figure 5A:
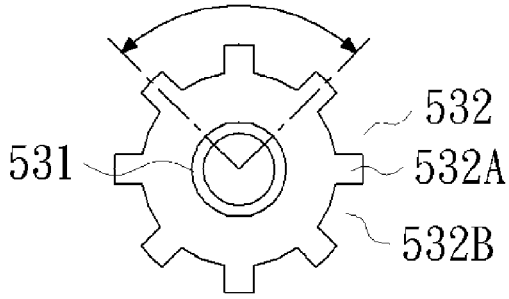
FIG. 5A shows an example of the electric fan according to the preferred teachings of the present invention with the electric fan capable of oscillating in 90°.
Figure 5B:
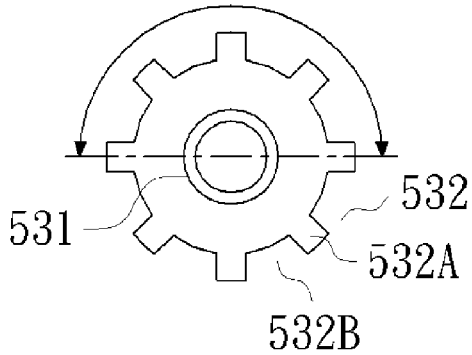
FIG. 5B shows another example of the electric fan according to the preferred teachings of the present invention with the electric fan capable of oscillating in 180°.
Figure 5C:
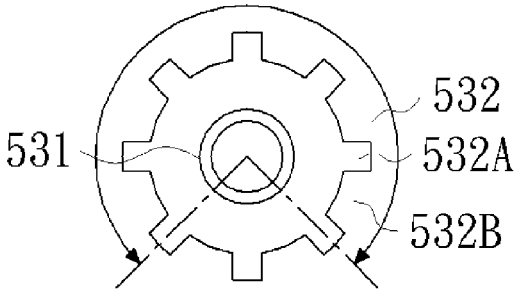
FIG. 5C shows a further example of the electric fan according to the preferred teachings of the present invention with the electric fan capable of oscillating in 270°.
Figure 5D:
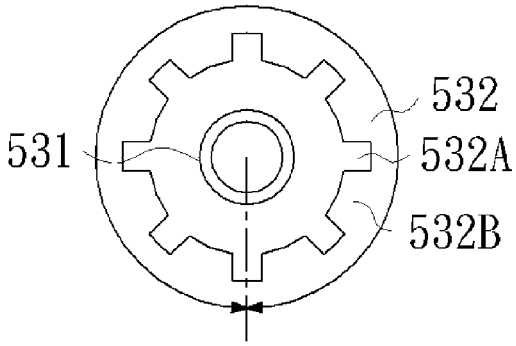
FIG. 5D shows still another example of the electric fan according to the preferred teachings of the present invention with the electric fan capable of oscillating in 360°.
Figure 6:
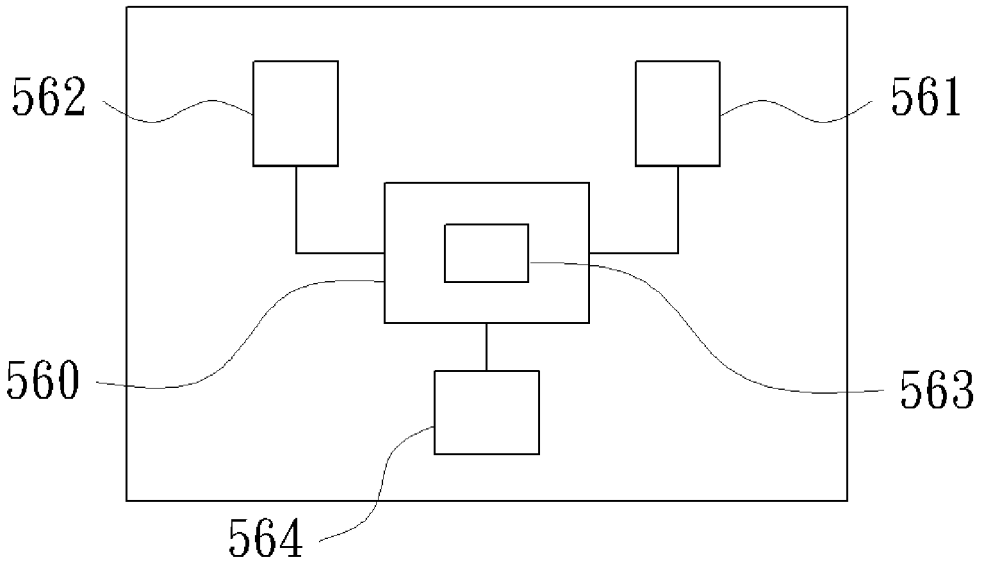
FIG. 6 shows a schematic block diagram of a circuit of the electric fan according to the preferred teachings of the present invention.

With reference to FIG. 3, to avoid entanglement of the power cord of the fan motor 2 during rotation of the rotational shaft 52, a printed circuit board (PCB) 7A is mounted to a bottom of the rotational shaft 52. The power cord of the fan motor 2 is divided into an upper section A and a lower section B. Two brushes 7B are provided on top of the PCB 7A. The upper and lower sections A and B are respectively and electrically connected to the PCB 7A and the brushes 7B. The division of the power cord can be varied according to differing functions. It can be appreciated that the electric fan can include only one brush 7B. Furthermore, the brush 7B and the PCB 7A can be in the form of an electrically conductive device with two parts such as copper plates or other electrically conductive elements.

Figure 2:
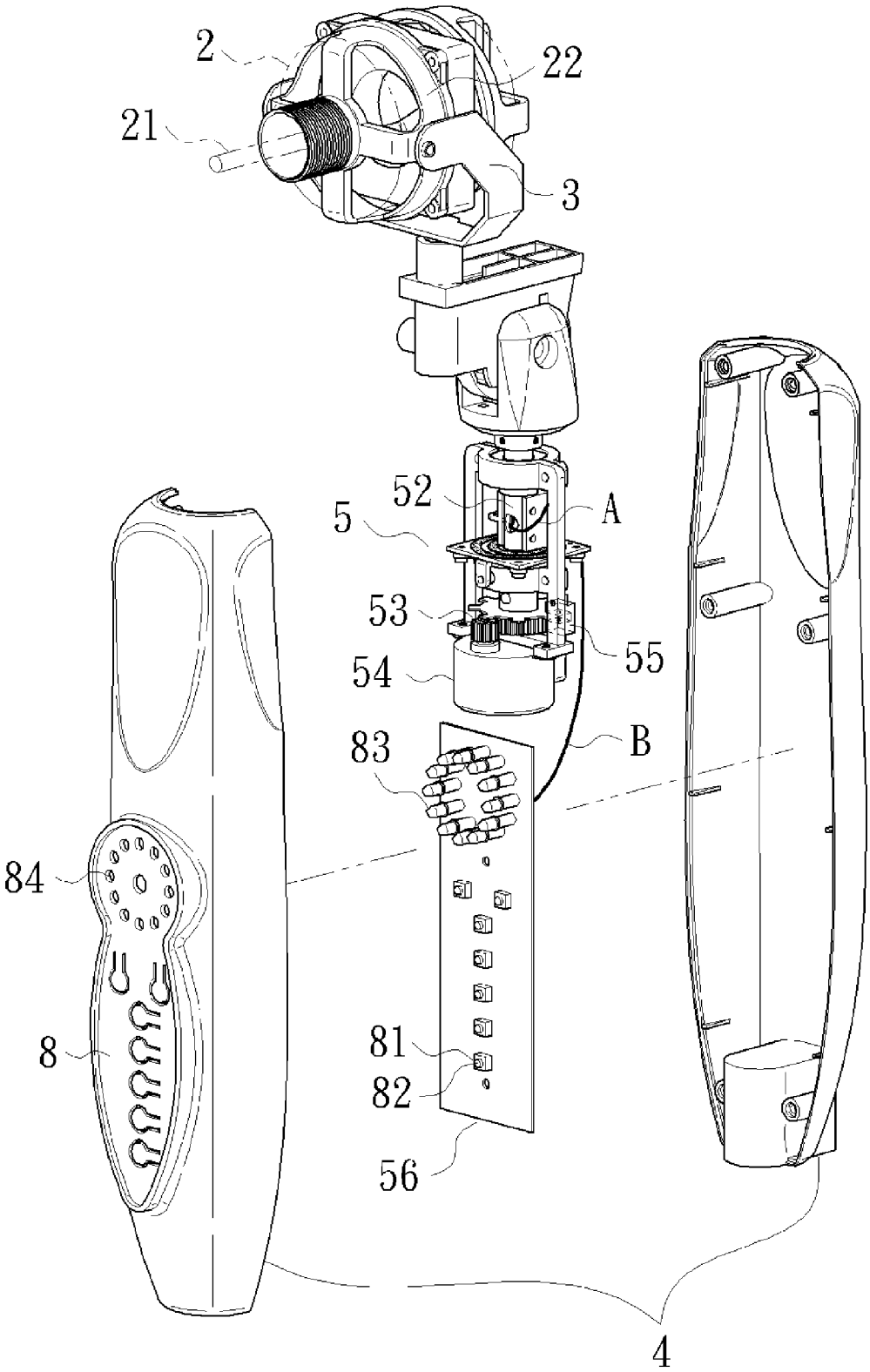
FIG. 2 shows a partial, exploded, perspective view of the electric fan of FIG. 1.

With reference to FIG. 2, selection or setting of the oscillating angle can be achieved by a control panel 8 mounted to a surface of the housing 4. The control panel 8 includes a plurality of buttons 81 corresponding to differing functions and differing oscillating angles. The buttons 81 are rooted in the circuit board 56. The control panel 8 includes a plurality of slots 82 through which the buttons 81 extend and, thus, exposed to the user for manual operation to control the circuit board 56. Furthermore, the control panel 8 can include a plurality of indicating lamps 83 rooted in the circuit board 56 and extending through a plurality of slots 84 in the control panel 8 to indicate operation of the control panel 56 as well as the status of the oscillating angle.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An electric fan with multiple selections of oscillating angles comprising:

a fan body including a plurality of vanes connected to a fan shaft;

a fan motor including a transmission shaft and a fixing portion, with the transmission shaft connected to the fan shaft for driving the fan shaft and the vanes to rotate;

a motor support connected to the fixing portion of the fan motor; and an oscillating device mounted in a housing and including:

a rotational shaft having an end connected to the motor support for driving the motor support to oscillate, a transmission gear including an axle and a gear wheel mounted around the axle, with the axle connected to the rotational shaft, a synchronous motor including an output gear meshed with the gear wheel, an oscillating angle limiting switch detecting a rotational angle of the rotational shaft and the gear wheel and sending a signal indicative of the rotational angle of the rotational shaft and the gear wheel, a circuit board including a processor coupled to the oscillating angle limiting switch and receiving the signal, with the circuit board storing data for a plurality of preset rotational angles, with a comparing program being stored in the circuit board for comparing the rotational angle indicated by the signal with a selected one of the plurality of preset rotational angles, and a driving program being stored in the circuit board for driving the synchronous motor when the rotational angle indicated by the signal is equal to the selected one of the plurality of preset rotational angles, and a printed circuit board mounted to a bottom of the rotational shaft, the fan motor including a power cord divided into an upper section and a lower section, with a brush mounted on top of the printed circuit board, and the upper and lower sections are respectively and electrically connected to the printed circuit board and the brush.

2. The electric fan as claimed in claim 1, with the oscillating angle limiting switch includes a photo sensor mounted in the housing, with a grating mounted to the transmission gear and including a plurality of protrusions, a groove formed between two adjacent protrusions, the photo sensor detecting an actual number of protrusions or grooves passing the photo sensor that corresponds to the rotational angle of the rotational shaft and the gear wheel, with the photo sensor converts the actual number of protrusions or grooves passing the photo sensor into a signal indicative of the actual number, and the comparing program includes a plurality of preset numbers corresponding to the plurality of preset rotational angles, with the comparing program comparing the actual number indicated by the signal with a selected one of the plurality of preset numbers, the driving program driving the synchronous motor when the actual number is equal to the selected one of the plurality of preset numbers.

3. The electric fan as claimed in claim 2, wherein the grating is located on top of and coaxial with the gear wheel.

4. The electric fan as claimed in claim 2, wherein the photo sensor has a substantially slanted U shape and includes an opening through which the protrusions and grooves of the grating pass.

5. The electric fan as claimed in claim 1, further comprising a timing program stored in the circuit board and executable to restrain the rotational angle of the synchronous motor.

* * * * *